United States Patent [19]

Pennell

[11] Patent Number: 4,621,377

[45] Date of Patent: Nov. 11, 1986

[54] HELMET ASSEMBLY

[75] Inventor: David N. Pennell, Covina, Calif.

[73] Assignee: Figgie International Inc., Willoughby, Ohio

[21] Appl. No.: 710,995

[22] Filed: Mar. 12, 1985

[51] Int. Cl.[4] ..... A42B 3/02

[52] U.S. Cl. ..... 2/6; 2/10; 403/187; 411/427

[58] Field of Search ..... 411/432, 427, 396, 397; 403/187; 2/6, 10

[56] References Cited

U.S. PATENT DOCUMENTS

| | | | |
|---|---|---|---|
| 2,671,630 | 3/1954 | Whitehead | 403/107 X |
| 2,860,343 | 11/1958 | Aileo | 2/6 X |
| 3,631,540 | 1/1972 | Penny | 2/6 |
| 4,170,792 | 10/1979 | Higgs | 2/10 |
| 4,199,823 | 4/1980 | Jenkins et al. | 2/6 X |
| 4,292,688 | 10/1981 | Ellis | 2/6 |

*Primary Examiner*—Werner H. Schroeder
*Assistant Examiner*—Andrew M. Falik
*Attorney, Agent, or Firm*—Christel, Bean & Linihan

[57] ABSTRACT

A helmet assembly (10) provided with either single or dual visor mechanisms (14, 16) and low profile right and left side pivot assembly (18, 20). A low profile visor actuating arm assembly (36, 38) is associated with each visor and the left hand pivot shaft (46) of the left side pivot assemblies (20). Each visor actuating arm assembly is capable of being readily manipulated by the left hand of a pilot so that the associated visor can be moved between fully raised and completely down positions, the visor actuating arm assembly also cooperating with the pivot shaft (46) to positively lock the visor in either of its fully raised or completely down positions. A pivot hub assembly (47) is also disclosed for securing the pivot shaft (46) to the helmet (12).

11 Claims, 7 Drawing Figures

Fig. 7.
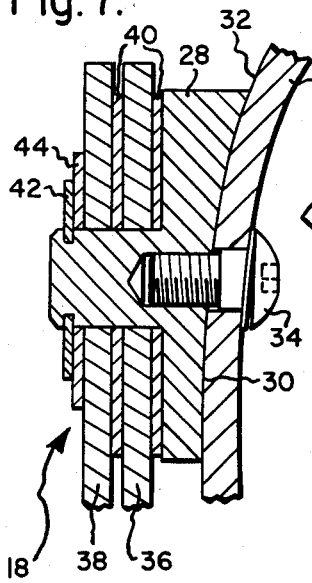
Fig. 6.
Fig. 4.
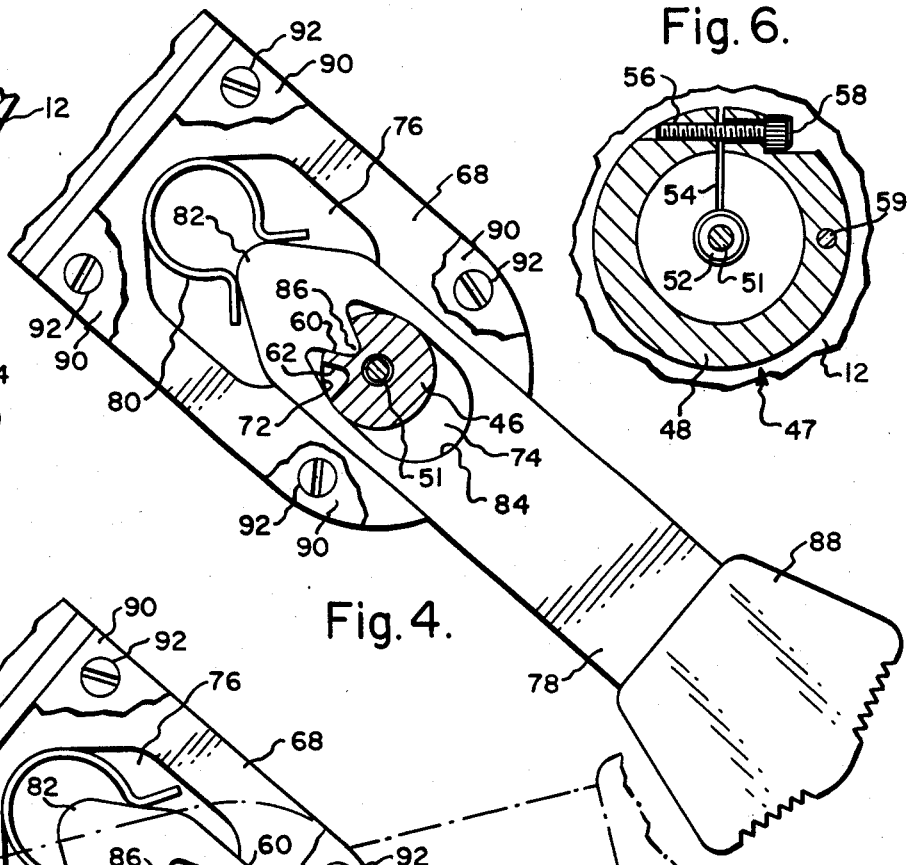
Fig. 5.
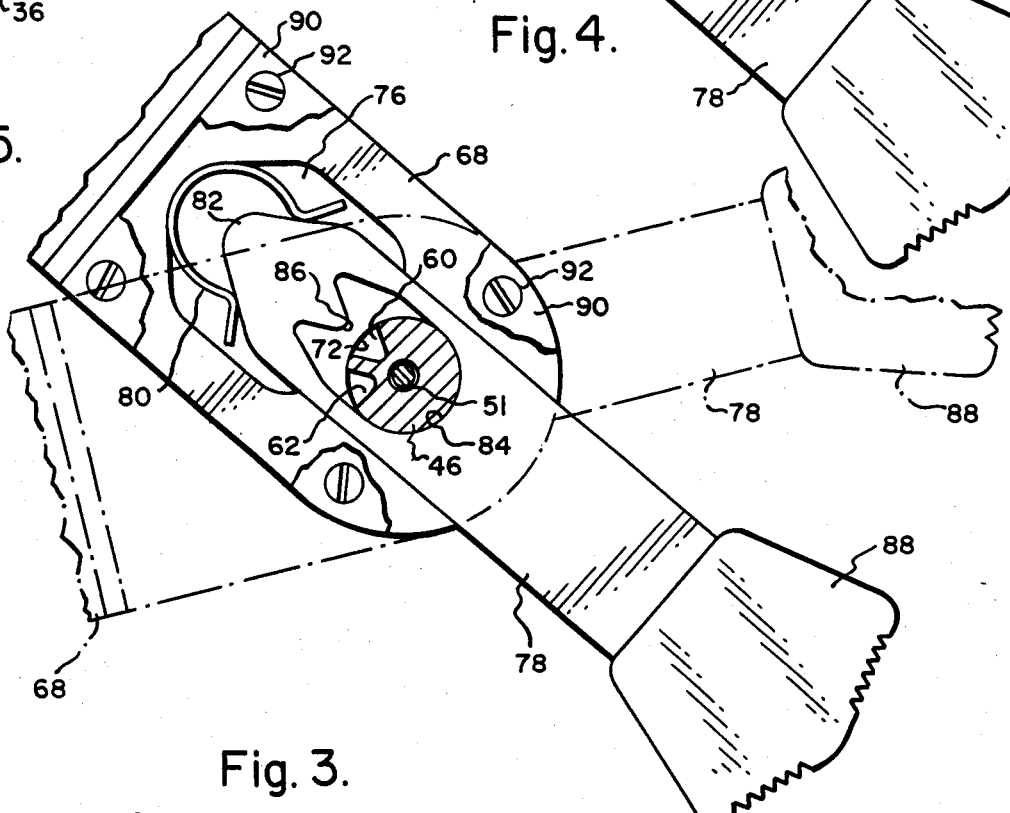
Fig. 3.
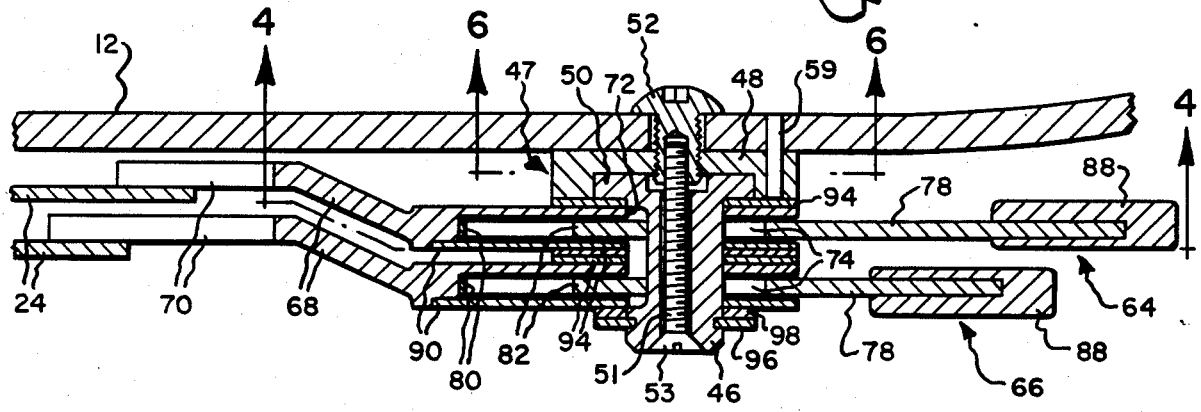

HELMET ASSEMBLY

FIELD OF THE INVENTION

The present invention relates generally to a helmet assembly of the type provided with either a single or a dual visor mechanism, and more particularly to an improved visor operating mechanism capable of either locking visors in their fully raised or completely down positions or of moving visors between their fully raised and completely down positions, said mechansim having a low profile and, when used with dual visors, being disposed entirely on the left-hand side of the helmet.

BACKGROUND

A pilot of a contemporary aircraft wears a helmet for his protection. Such a helmet is usually provided with at least one visor and in many cases with two visors. A typical prior art helmet, which employs two visors, is shown in U.S. Pat. No. 3,593,338. This general form of construction includes mechanisms which permit the visors to be moved between their fully raised and completely down positions. One of the mechanisms is disposed upon the right-hand side of the helmet and the other mechanism is disposed upon the left-hand side of the helmet. However, it has been found that this form of construction is somewhat disadvantageous because the control of an aircraft is nearly always done with the right hand. Thus, the pilot cannot have complete control of his aircraft if he has to switch hands to change visor position. Therefore, when dual visors are to be utilized with a helmet, it is desirable that the visor operating mechanisms be so disposed that both mechanisms can be operated by the left hand.

A construction which permits left-hand operation of dual visors is shown in West German Offenlegungsschrift 2736121. A principal disadvantage of this form of design is that the operating mechanisms extend substantially to one side of the helmet thus increasing its side profile. It is desirable that the visor operating mechanism have a generally low profile, or more specifically, be located as close to the helmet surface as possible. In addition, this device does not lock the visors to their desired positions. It is imperative to have visors that lock in position to reduce the risk of injury to the eyes should pilot ejection occur. Should a visor cease being a shield for the eyes during ejection, the force of winds encountered can cause damage if not permanent blindness to the pilot. It is a well established fact that wind blast will cause a visor(s) to lift from its lowered protective position.

Another relevant patent is U.S. Pat. No. 4,199,823. This patent discloses a dual visor helmet having actuating handles on the left-hand side. This patented design also does not provide for positive detenting positions. In addition, it is difficult to mount a visor shield in this patented design due to the actuating mechanism being disposed between the visor and its pivot. If further requires more parts which, in most cases, increases the overall weight. Due to what appears to be a substantial increase in helmet profile, this allows the possibility of parachute shroud lines to become entangled around the mechanism's handles.

OBJECTS AND SUMMARY OF THE INVENTION

It is an object of the present invention to provide a helmet assembly having an improved single side actuated visor operating mechanism of low profile, of relatively low cost, of high durability and of light weight.

In addition, it is a further object of the present invention to provide a helmet assembly having a single side actuated visor operating mechanism suitable for use with dual visors, the operating mechanisms for actuating the visors all being capable of being disposed upon the same side of the helmet and having a low profile.

It is a further object of the present invention to provide a visor actuating arm assembly for a helmet assembly wherein the visor actuating arm assembly can be readily manipulated by the left hand of a pilot so that the visor can be moved between fully raised and completely down positions, the visor actuating arm assembly also cooperating with a pivot shaft to positively lock the visor in either its fully raised or completely down position.

It is yet another object of the present invention to reduce the profile of helmet visors and their actuating mechanisms so that a visor shield, which customarily is employed to cover the visors, will also have a lower profile. By reducing the profile of the overall helmet, the pilot, when ejecting from an aircraft, will have a reduced cross sectional area when he clears the windshield during ejection, thus reducing somewhat the possibility of head and neck injuries during ejection.

It is a further object of the present invention to provide a novel pivot hub assembly for securing the pivot shaft to the helmet.

In accordance with the principles of this invention, a helmet may be provided with a first visor, or first and second visors movable between raised and lowered positions. A right side pivot pivotally connects the right side of the visor(s) to the right side of the helmet. Similarly, a left side pivot assembly pivotally connects the left side of the visor(s) to the left side of the helmet. The left side pivot assembly includes a pivot shaft fixed to the left side of the helmet and extending outwardly therefrom, and a visor actuating arm assembly for each visor. Each arm assembly is journalled about the pivot shaft and is capable of being locked to the pivot shaft to prevent movement of the visor.

The foregoing objects and other objects and advantages of the present invention, as well as the structure required to accomplish the various objects and advantages of this invention, will become more apparent after a consideration of the following detailed description taken in conjunction with the accompanying drawings in which a preferred form of this invention is illustrated.

BRIEF DESCRIPTION OF THE FIGURES

FIG. 3 is an enlarged sectional view taken generally along the line 3—3 in FIG. 1 and showing inner and outer visor actuating arm assemblies and a pivot shaft which is fixed to the helmet by means of a pivot hub assembly.

FIG. 4 is view taken along the line 4—4 in FIG. 3 and showing the inner visor actuating arm assembly in its raised position, this view also showing the manually operable detenting slide of the visor actuating arm assembly in its normal position.

FIG. 5 is a view similar to FIG. 4 but showing in full line the manually operable detenting slide when moved against spring bias from its normal position, and also showing in phantom lines the visor actuating arm assembly in its lower position.

FIG. 6 is a sectional view taken generally along the line 6—6 in FIG. 3 illustrating the pivot hub assembly.

FIG. 7 is a sectional view taken generally along the line 7—7 in FIG. 2 illustrating the right side pivot assembly.

DETAILED DESCRIPTION OF A PREFERRED EMBODIMENT

Figure 1:
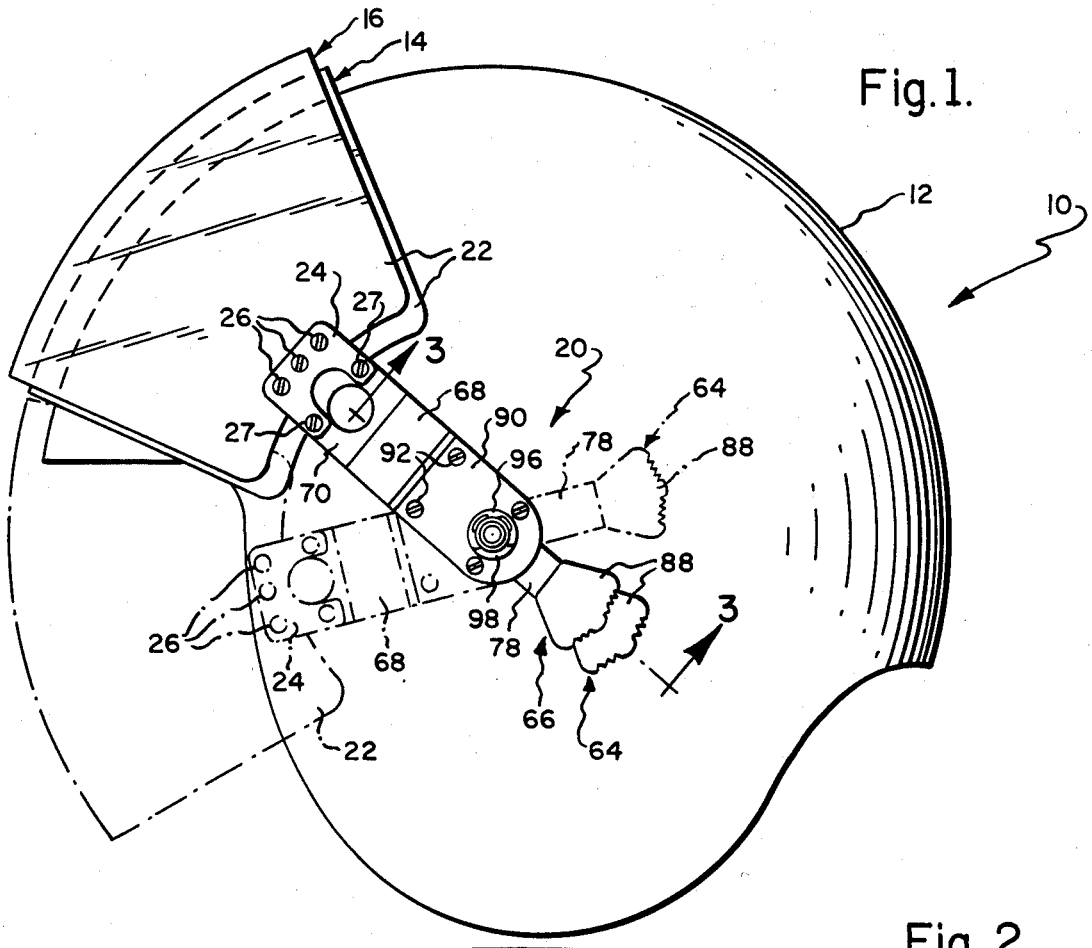
FIG. 1 is a side view of a helmet in which the principles of the present invention have been incorporated.
Figure 2:
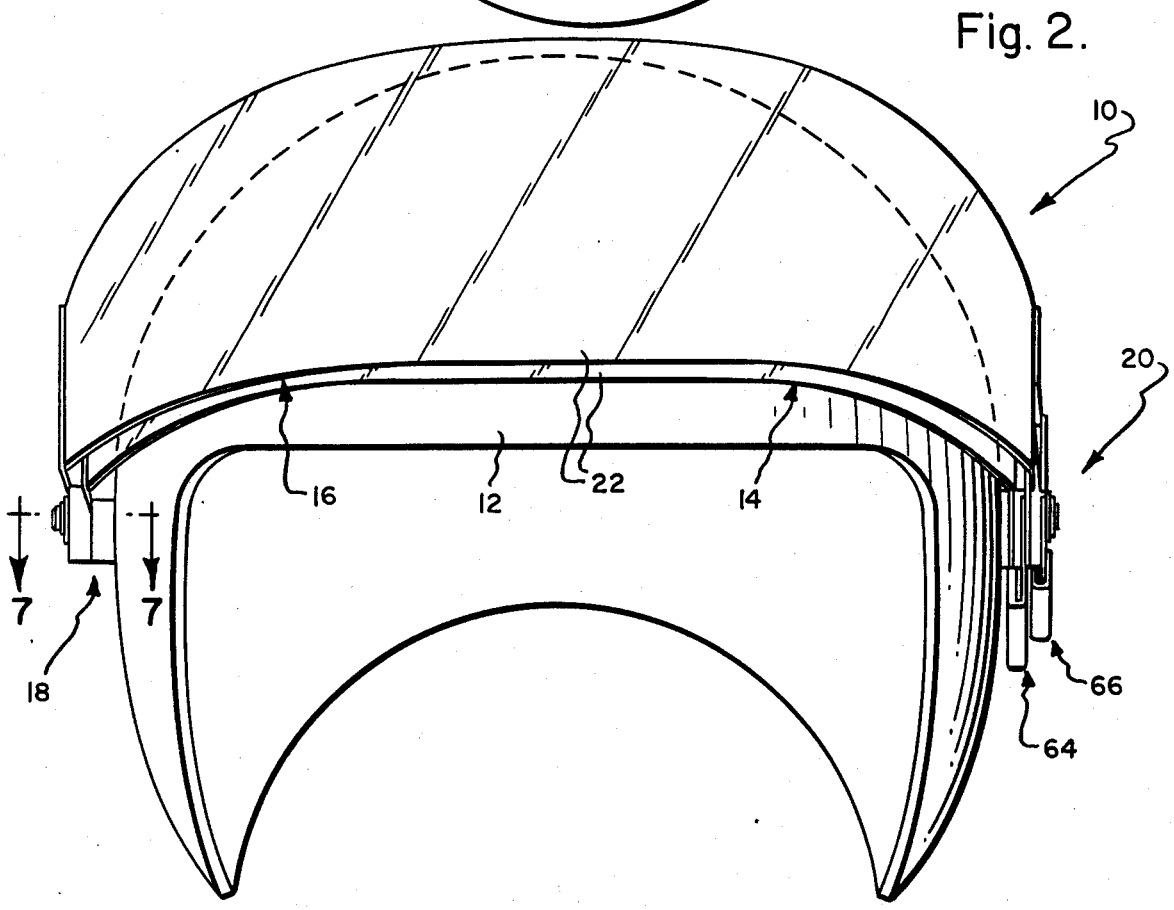
FIG. 2 is a front view of the helmet illustrated in FIG. 1.

Referring first to FIGS. 1 and 2, a helmet assembly is shown, the helmet assembly being indicated generaly at 10. The assembly 10 includes a helmet 12, movable first and second visors 14, 16, and right side and left side pivot means or assemblies indicated generally at 18 and 20, respectively, which pivot means mount the visors on the helmet 12 for movement between fully raised and completely down positions.

The helmet 12 is of a typical construction customarily worn by aviators and therefore details of the helmet are not illustrated. However, as is customary, the helmet 12 is provided with an inner liner which contacts the head of the wearer, the liner not being illustrated in these drawings.

One of the visors 14, 16 may have a clear lens 22 and the other visor lens 22 may be suitably tinted to reduce glare. The wearer of the helmet may wish to have both visors in their fully raised position, shown in full lines in FIG. 1, or either one of the visors in the completely down position, this being illustrated in broken lines in FIG. 1 for the inner visor. Therefore, it is necessary to provide separate actuating mechanisms for each of the visors which will permit entirely independent movement of the associated visor. Each of the visors 14, 16 includes, in addition to the lens portion 22, relatively thin visor brackets 24, there being brackets attached to both the right-hand and left-hand sides of the associated lens portion 22. To this end, the visor brackets 24 are provided with suitable apertures through which fasteners 26 may pass, the fasteners 26 securing the brackets 24 to the lens portion 22. The end of the brackets 24 spaced away from the lens are provided with additional apertures through which additional fasteners 27 may pass, these fasteners 27 in turn securing the brackets 24 to an arm of an associated pivot assembly.

The right side pivot assembly 18 includes a combined mounting pad and pivot post 28 (FIG. 7), the pad portion having a surface 30 which is adapted to conform to the exterior surface 32 of the helmet 12 adjacent the mounting location. The mounting pad and pivot post are suitably tapped, and similarly, the helmet 12 is suitably drilled for the reception of a fastener 34 which is utilized to secure the mounting and pivot post to the right side of the helmet. Secured to the brackets 24 on the right-hand side of the visors 14 and 16 are visor mounting arms, there being an inner or first right-hand visor mounting arm 36 and an outer or second right-hand visor mounting arm 38. Each of the visor mounting arms 36, 38 is provided with a suitable aperture which receives the pivot post of the combined mounting pad and pivot post 28. The arms 36, 38 are suitably spaced away from each other and the mounting pad 28 by suitable washers 40 which are preferably formed of a low friction material such a polytetrafluoroethylene. The parts are held together in their assembled position by a snap ring 42 which engages another washer 44, the snap ring 42 being received in a groove at the end of the pivot post.

As shown in FIGS. 3 and 6, the left side pivot means 20 includes a pivot shaft 46 which is secured to the left side of the helmet by a pivot hub assembly, indicated generally at 47. The pivot hub assembly includes a mounting pad 48 having an enlarged central recessed area which can receive the head 50 of the pivot shaft 46, the head 50 being an enlarged cylindrical portion. The mounting pad 48 is provided with a central aperture which is adapted to be lined up with a corresponding aperture in the helmet 12, a fastener 52 passing through the apertures to secure the mounting pad 48 to the helmet 12. The pivot 46 is additionally secured to the mounting pad 48 by a screw 53 which is received within a countersunk bore in the pivot shaft and is screwed into a tapped aperture in the fastener 52. As can best be seen from FIG. 6, the mounting pad 48 has a slot 54 running from the central aperture to the peripheral edge of the pad. Disposed to one side of the slot 54 is a tapped aperture 56, and, on the other side of the slot, an enlarged aperture is disposed in alignment with the tapped aperture for the receipt of a clamping screw 58. While not shown in FIG. 6, it can be seen that the head 50 of the pivot shaft can be received within the recessed area of the mounting pad and be clamped thereto in various positions of rotational adjustment by tightening the clamping screw 58.

An anit-rotation pin 59 is press fitted through suitable apertures in the pad 48 and helmet 12 to provide added insurance against the possibility of the pad rotating on the helmet. The pivot shaft 46 is provided with a pair of circumferentially spaced apart axially extending grooves 60, 62 on its peripheral surface and the rotational position of these grooves can be adjusted by loosening the clamping screw 58 and turning the pivot shaft 46 to the desired position, and then by retightening the clamping screw 58.

The left side pivot means further includes inner or first and outer or second visor actuating arm assembly means, indicated generally at 64, 66, respectively in FIG. 3. Each of the arm assembly means is journalled on the pivot shaft for rotational movement from the fully raised position indicated in full lines in FIG. 5 to the completely down position indicated in phantom in FIG. 5. Each of the visor actuating arm assembly means includes a visor mounting arm 68. The visor mounting arms 68 for both the inner and outer visor actuating arm assemblies are essentially identical except that the visor mounting arm for the outer visor actuating arm assembly is slightly longer as can be seen from FIG. 3. Each of the arms 68 is provided with a forward portion 70 (also shown in FIG. 1) which can receive the fasteners 27 which are utilized to secure the left hand brackets 24 to the forward portion of the visor mounting arms 68.

Disposed to the rear of the forward portion 70 of each visor mounting arm is an intermediate pivot opening 72 which receives the pivot shaft 46. The pivot opening is circular and is also essentially of the same diameter as the diameter of the pivot shaft 46 so that the arm 68 can pivot about the shaft 46.

The surface of each of the mounting arms 68 is provided with a recessed slide receiving portion 74 (FIG. 3) which has parallel sidewalls. Disposed between the slide receiving portion 74 and the forward portion 70 is an enlarged recess 76. A manually operable detenting slide 78 is received within the recessed slide receiving portion 74 and has a height not greater than the depth of said slide receiving portion.

The visor actuating arm assembly further includes biasing means in the form of a C-shaped resilient clip 80 which is received within the enlarged recess 76, the C clip also having a height not greater than the depth of said recess. The C clip will normally bias the slide means 78 to its normal detenting position shown in FIG. 4. In this connection, it should be noted that the forward end 82 of the slide means 78 is tapered. The sides of the tapered end are engaged by the ends of the C clip and if the slide is moved in a forward direction towards the forward portion 70 of the arm 68 the tapered end surface will spread apart the ends of the C clip. If the slide means 78 is then released the resilient C clip 80 will then force the slide means 78 from its unlocking position shown in FIG. 5 to its locking or detenting position shown in FIG. 4. In order to provide for such sliding movement of the slide 78, it is provided with an oblong opening 84 which receives the pivot shaft 46. The forward end of the oblong opening is provided with an inwardly extending detent 86 which may engage either one of the peripherally spaced apart grooves 60, 62 to hold the visor actuating arm assembly means and the associated visor in one or two fixed positions. To facilitate the operation of the manually operable detenting slide means, a thumb pad 88 is provided at the rear end of the slide 78.

In order to maintain the slide 78 and C clip 80 in the proper assembled position, a cover plate 90 is provided, which cover plate is provided with an aperture for the reception of the pivot shaft 46 and is held in place by suitable fasteners 92.

As in the right side pivot means 16, suitable low friction washers 94 are provided between the mounting pad 48 and the inner visor actuating arm assembly means 64 and also between the inner and outer visor actuating arm assembly means. Finally, the parts are held in their assembled position by a snap ring 96 which is received within a suitable groove on the pivot 46, the snap ring 96 in turn bearing against another washer 98.

As can be seen best from FIG. 3, each of the slide means 78 is of a differing length. Thus, the slide means 78 associated with the inner visor actuating arm assembly is longer than the slide means 78 associated with the outer visor actuating arm assembly. However, both thumb pads and actuating mechanisms are located on the left side of the aviator's helmet and do not project outwardly an excessive distance. The pilot wearing the helmet assembly can simply move a selected visor between its raised and lowered positions by engaging the associated thumb pad 88 with the left-hand thumb, pushing the thumb pad forward to release the detent 86 from the associated groove 60 or 62, and then by rotating the whole assembly until the detent 86 is essentially lined with the other of the grooves 60, 62 whereupon the aviator can then release the thumb pad, the C clip forcing the slide 78 to its rear position to lock the visor in the desired final assembled position.

It can be seen from the above that the visors can be readily manipulated between their raised and lowered positions, and that the design is both of a relatively simple and of a relatively durable construction. In addition, by utilizing the above construction, it is possible to have a relatively low profile helmet.

What is claimed is:

1. A low profile mechanism for the retention and actuation of a visor on an aircraft flight helmet assembly of the type having a helmet, a first visor, and right and left side pivot means which mount the visor on the helmet for movement between fully raised and completely down positions, said mechanism for the retention and actuation of the visor being incorporated in the left side pivot means which comprises:

a pivot shaft fixed to the left side of said helmet and extending outwardly therefrom; and first visor actuating arm assembly means journalled on said pivot shaft and capable of causing the first visor to be moved between its raised and lowered positions, said first visor actuating arm assembly means including a visor mounting arm having a forward portion secured to the first visor, and an intermediate opening which receives the pivot shaft, a manually operable slide means slidably supported by said visor mounting arm for sliding movement between locking and unlocking positions, said slide means being provided with an oblong opening between its ends which receives said pivot shaft, said slide means, when in the unlocking position capable of being rotated about said pivot shaft to cause corresponding movement of the associated visor mounting arm and visor to thereby move said visor between raised and lowered positions, and said slide means, when in the locking position, capable of locking the associated visor mounting arm and visor from rotational movement about said pivot shaft, and biasing means supported by said visor mounting arm and engageable with said slide means and operable to normally bias the slide means to its locking position.

2. The helmet assembly as set forth in claim 1 wherein said oblong opening is provided with an inwardly extending detent wall.

3. The helmet assembly as set forth in claim 2 wherein said pivot shaft is provided with spaced apart axially extending grooves on its peripheral surface, the inwardly extending detent wall engaging one of said grooves when the manually operable detenting slide means is in its locking position.

4. A low profile mechanism for the retention and actuation of a visor on an aircraft flight helmet assembly of the type having a helmet, a first visor, and right and left side pivot means which mount the visor on the helmet for movement between fully raised and completely down positions, said mechanism for the retention and actuation of the visor being incorporated in the left side pivot means which comprises:

a pivot shaft fixed to the left side of said helmet and extending outwardly therefrom; and a first visor actuating arm assembly means journalled on said pivot shaft and capable of causing the first visor to be moved between its raised and lowered positions, said first visor actuating arm assembly means including a visor mounting arm having a forward portion secured to the first visor, and an intermediate opening which receives the pivot shaft, a manually operable slide means slidably supported by said visor mounting arm for sliding movement between locking and unlocking positions, one end of said slide means being tapered, said slide means, when in the unlocking position capable of being rotated about said pivot shaft to cause corresponding movement of the associated visor mounting arm and visor to thereby move said visor between raised and lowered positions, and said slide means, when in the locking position, capable of locking the associated visor mounting arm and visor from rotational movement about said pivot shaft, and biasing means in the form of a C-shaped resilient clip supported by said visor mounting arm, the ends of the C-shaped resilient clip being engageable with the tapered end of said slide means and operable to normally bias the slide means to its locking position away from said C-shaped resilient clip.

5. The helmet assembly as set forth in claim 4 wherein the C-shaped resilient clip is disposed between said pivot shaft and the visor, and wherein said one end of the slide means is in the forward end.

6. The helmet assembly as set forth in claim 5 wherein the rear end of said slide means is provided with a thumb pad to facilitate manipulation of said visor actuating arm assembly means.

7. A low profile mechanism for the retention and actuation of a visor on an aircraft flight helmet assembly of the type having a helmet, a first visor, and right and left side pivot means which mount the visor on the helmet for movement between fully raised and completely down positions, said mechanism for the retention and actuation of the visor being incorporated in the left side pivot means which comprises:

a pivot shaft fixed to the left side of said helmet and extending outwardly therefrom; and first visor actuating arm assembly means journalled on said pivot shaft and capable of causing the first visor to be moved between its raised and lowered positions, said first visor actuating arm assembly means including a visor mounting arm having a forward portion secured to the first visor, a recessed radially extending slide receiving portion, and an intermediate opening which receives the pivot shaft, a manually operable slide means supported by said recessed slide receiving portion for radial sliding movement between locking and unlocking positions, said slide means, when in the unlocking position capable of being rotated about said pivot shaft to cause corresponding movement of the associated visor mounting arm and visor to thereby move said visor between raised and lowered positions, and said slide means, when in the locking position, capable of locking the associated visor mounting arm and visor from rotational movement about said pivot shaft, and biasing means supported by said visor mounting arm and engageable with said slide means and operable to normally bias the slide means to its locking position.

8. The helmet as set forth in claim 7 wherein said visor mounting arm is further provided with an enlarged recess forward of the recessed slide receiving portion, said enlarged recess receiving said biasing means.

9. The helmet assembly as set forth in claim 8 further characterized by the provision of a cover plate adapted to close the recessed slide receiving portion and the enlarged recess to maintain the biasing means and the slide means in their assembled position.

10. A low profile mechanism for the retention and actuation of a visor on an aircraft flight helmet assembly of the type having a helmet, a first visor, and right and left side pivot means which amount the visor on the helmet for movement between fully raised and completely down positions, said mechanism for the retention and actuation of the visor being incorporated in the left side pivot means which comprises:

a pivot shaft nonrotatably fixed to the left side of said helmet and extending outwardly therefrom, said pivot shaft being provided with radially spaced apart detent receiving portions; and first visor actuating arm assembly means journalled on said pivot shaft and capable of causing the first visor to be moved between its raised and lowered positions, said first visor actuating arm assembly means including a visor mounting arm having a forward portion secured to the first visor, and an intermediate opening which receives the pivot shaft, a manually operable detenting slide means slidably supported by said visor mounting arm for sliding movement between locking and unlocking positions, said slide means being provided with a detent capable of being received within one of the spaced apart detent receiving portions on the pivot shaft to positively lock the visor mounting arm and the associated first visor in either the fully raised or the complete down position, said slide means, when in the unlocking position capable of being rotated about said pivot shaft to cause corresponding movement of the associated visor mounting arm and visor to thereby move said visor between raised and lowered positions, and biasing means supported by said visor mounting arm and engageable with said slide means and operable to normally bias the slide means to its locking position.

11. The helmet assembly as set forth in claim 10 further characterized by the provision of a second visor movable between raised and lowered positions, the second visor being disposed outwardly of the first visor, said right side pivot means also pivotally connecting the right side of the second visor to the right side of the helmet, and said left side pivot means also pivotally connecting the left side of the second visor to the left side of the helmet, said left side pivot means additionally being characterized by a second visor actuating arm assembly means substantially identical to the first visor actuating arm assembly, said second visor actuating arm assembly means being disposed outwardly of said first visor actuating arm assembly means.

* * * * *